US006772599B2

(12) United States Patent
Bodell, II et al.

(10) Patent No.: US 6,772,599 B2
(45) Date of Patent: Aug. 10, 2004

(54) STABILITY CONTROL SYSTEM AND METHOD FOR COMPRESSORS OPERATING IN PARALLEL

(75) Inventors: Mark Robinson Bodell, II, York, PA (US); Wanda Jean Miller, Harrisburg, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/619,640

(22) Filed: Jul. 15, 2003

(65) Prior Publication Data

US 2004/0025523 A1 Feb. 12, 2004

Related U.S. Application Data

(60) Provisional application No. 60/401,355, filed on Aug. 6, 2002.

(51) Int. Cl.[7] ..... F25B 49/02

(52) U.S. Cl. ..... 62/129; 62/175; 62/217; 62/228.5; 62/230; 62/510

(58) Field of Search ..... 62/125, 126, 127, 62/129, 130, 131, 175, 217, 228.1, 228.3, 228.4, 228.5, 230, 510

(56) References Cited

U.S. PATENT DOCUMENTS

| | | | | |
|---|---|---|---|---|
| 3,648,479 | A | 3/1972 | Richardson | |
| 3,957,392 | A | 5/1976 | Blackburn | |
| 4,152,902 | A | 5/1979 | Lush | |
| 4,248,055 | A | 2/1981 | Day, III et al. | |
| 4,363,596 | A | 12/1982 | Watson et al. | |
| 4,503,684 | A | 3/1985 | Mount et al. | |
| 4,514,989 | A | 5/1985 | Mount | |
| 4,581,900 | A | 4/1986 | Lowe et al. | |
| 4,608,833 | A | 9/1986 | Kountz | |
| 4,646,530 | A | 3/1987 | Huenniger | |
| 4,656,589 | A | 4/1987 | Albers et al. | |
| 5,108,263 | A | 4/1992 | Blotenberg | |
| 5,207,559 | A | 5/1993 | Clevenger et al. | |
| 5,222,356 | A | 6/1993 | Evenson et al. | |
| 5,235,801 | A | 8/1993 | Evenson et al. | |
| 5,284,026 | A | 2/1994 | Powell | |
| 5,355,691 | A | 10/1994 | Sullivan et al. | |
| 5,651,264 | A | 7/1997 | Lo et al. | |
| 5,669,225 | A | 9/1997 | Beaverson et al. | |
| 5,730,580 | A | 3/1998 | Japikse | |
| 5,746,062 | A | 5/1998 | Beaverson et al. | |
| 5,845,509 | A | 12/1998 | Shaw et al. | |
| 5,873,257 | A | 2/1999 | Peterson | |
| 5,875,637 | A | 3/1999 | Paetow | |
| 5,894,736 | A | 4/1999 | Beaverson et al. | |
| 5,913,248 | A | 6/1999 | Harada et al. | |
| 5,927,939 | A | 7/1999 | Harada et al. | |
| 6,014,325 | A | 1/2000 | Pecore | |
| 6,427,464 | B1 * | 8/2002 | Beaverson et al. | 62/196.3 |
| 2002/0020175 | A1 | 2/2002 | Street et al. | |

FOREIGN PATENT DOCUMENTS

| | | |
|---|---|---|
| EP | 0 186 332 A1 | 7/1986 |
| EP | 0 576 238 A1 | 12/1993 |
| JP | 3-78598 | 4/1991 |

* cited by examiner

*Primary Examiner*—Harry B. Tanner
(74) *Attorney, Agent, or Firm*—Brian T. Sattizahn; McNees Wallace & Nurick LLC

(57) ABSTRACT

A control system is provided to maintain stable operating conditions for centrifugal compressors operating in parallel when one of the centrifugal compressors enters into an unstable operating condition. The control system determines an unstable operating condition in response to signals indicating the motor current or power consumption of each compressor and the position of the pre-rotation vanes of the compressors. Once an unstable operating condition is determined, the control system closes the pre-rotation vanes to each compressor until the unstable operating condition has been corrected.

30 Claims, 2 Drawing Sheets

STABILITY CONTROL SYSTEM AND METHOD FOR COMPRESSORS OPERATING IN PARALLEL

CROSS-REFERENCE TO RELATED APPLICATIONS

This application claims the benefit of U.S. Provisional Application No. 60/401,355 filed Aug. 6, 2002.

BACKGROUND OF THE INVENTION

The present invention relates generally to a control system for compressors operating in parallel. Specifically, the present invention relates to a control system that re-establishes the stability of dual centrifugal compressors operating in parallel upon one of the centrifugal compressors entering into an unstable operating condition such as a surge condition.

To obtain increased capacity in a refrigeration system, two compressors can be connected in parallel to a common refrigerant circuit. Frequently, for capacity control, one of the compressors is designated as a "lead" compressor and the other compressor is designated as a "lag" compressor. The capacity of the refrigeration system, and of each compressor, can be controlled by the use of adjustable pre-rotation vanes or inlet guide vanes incorporated in or adjacent to the suction inlet of each compressor. Depending on the particular capacity requirements of the system, the pre-rotation vanes of each compressor can be positioned to control the flow of refrigerant through the compressors and thereby control the capacity of the system. The positions of the pre-rotation vanes can range from a completely open position to a completely closed position. The pre-rotation vanes for a compressor can be positioned in a more open position to increase the flow of refrigerant through the compressor and thereby increase the capacity of the system or the pre-rotation vanes of a compressor can be positioned in a more closed position to decrease the flow of refrigerant through the compressor and thereby decrease the capacity of the system.

One frequently used method to control the capacity of a refrigeration system is to control the position of the pre-rotation vanes of a compressor in response to a deviation from a desired set point of the leaving chilled water temperature in the evaporator. For a system with two parallel compressors, the pre-rotation vanes of the lead compressor are controlled based on the leaving chilled water temperature and the pre-rotation vanes of the lag compressor are controlled to follow the capacity of the lead compressor. In one technique, to follow the capacity of the lead compressor, the pre-rotation vanes of the lag compressor are positioned to obtain the same percentage of full-load motor current in the lag compressor that is present in the lead compressor.

During the operation of centrifugal compressors, a compressor instability or surge can occur in a centrifugal compressor. Surge or surging is an unstable condition that may occur when compressors, such as centrifugal compressors, are operated at light loads and high pressure ratios. Surge is a transient phenomenon having high frequency oscillations in pressures and flow, and, in some cases, the occurrence of a complete flow reversal through the compressor. Surging, if uncontrolled, can cause excessive vibrations in both the rotating and stationary components of the compressor, and may result in permanent compressor damage. During a surge condition there can exist a momentary reduction in flow and pressure developed across the compressor. Furthermore, there can be a reduction in the net torque and mechanical power at the driving shaft of the compressor. In the case where the drive device of the compressor is an electric motor, the oscillations in torque and power caused by a surge condition can result in oscillations in motor current and excessive electrical power consumption.

As discussed above, a surge condition in a centrifugal compressor can result in a reduction in motor current or load on the compressor or a reduction in discharge pressure or temperature from the compressor. Thus, the presence of a surge condition can be detected by measuring the motor current or load on the compressor or the discharge pressure or temperature from the compressor and checking for the appropriate reduction in the measured amount. It is to be understood that other operational parameters, in addition to the ones discussed above, can be used to detect the presence of a surge condition.

When a surge or lack of pumping condition occurs on one compressor in dual compressor applications, the compressor which does not surge has an increase in refrigerant flow. The increase in refrigerant flow to the non-surging compressor makes it more difficult for the surging compressor to overcome the instability. One technique for overcoming a surge condition in a dual compressor configuration is disclosed in U.S. Pat. No. 4,646,530, hereafter referred to as the U.S. Pat. No. '530 . The U.S. Pat. No. '530 is directed to the operation of a refrigeration system having a pair of centrifugal compressors connected in parallel. During a surge condition in the lag compressor, the control operation of the compressors is changed from the normal control operation to a surge control operation. In the U.S. Pat. No. '530 , a surge condition is detected when the motor current of the lag compressor is more than a selected percentage below the lead compressor motor current. If a surge condition is detected to be present for a predetermined period of time, the inlet guide vanes to the lead compressor are closed for another predetermined period of time to increase the flow of refrigerant and current in the lag compressor. If the current in the lag compressor increases above the selected percentage, after the predetermined time period for the closing of the vanes of the lead compressor, normal control operation of the compressors is resumed. One drawback of this technique is that it can only detect and correct a surge condition in the lag compressor and does not address a surge condition in the lead compressor. Another drawback of this technique is that a predetermined time has to elapse before a response to the surge condition is provided.

Another technique for controlling surge in a dual compressor arrangement is disclosed in U.S. Pat. No. 5,845,509 hereafter referred to as the U.S. Pat. No. '509 . The U.S. Pat. No. '509 is directed to a refrigeration system using a plurality of centrifugal compressors operated in parallel. To avoid surge in a two compressor system, the lag compressor is initially shut off in a reduced load situation to thereby increase the rotational speed of the other compressor and avoid a surge condition. However, if load conditions continue to decrease and the surge condition has not been avoided, the lag compressor is re-started and the lead compressor is shut down to attempt to avoid the surge condition. One drawback of this technique is that the compressors can be cycled on and off several times in attempting to avoid surge conditions thereby resulting in significant power consumption.

Therefore, what is needed is a control system and method for dual centrifugal compressors operated in parallel that can detect a surge condition in either the "lead" compressor or the "lag" compressor and can correct the surge condition in the compressor without a complex procedure or repeated on-off cycling of compressors.

SUMMARY OF THE INVENTION

One embodiment of the present invention is directed to a method for detecting compressor instability in a multiple compressor refrigeration system. The method includes the steps of determining an operating parameter from both a first compressor of a multiple compressor refrigeration system and a second compressor of the multiple compressor refrigeration system. The operating parameter of the first compressor is then compared to the operating parameter of the second compressor. Next, an inlet vane position for both the first compressor and the second compressor is determined. Finally, the inlet vane position of the first compressor is compared to the inlet vane position of the second compressor and a compressor instability is determined in one of the compressors in response to that compressor having both a lower operating parameter and a more open inlet vane position than the other compressor.

Another embodiment of the present invention is directed to a computer program product embodied on a computer readable medium and executable by a microprocessor for detecting a compressor instability in a multiple compressor refrigeration system. The computer program product includes computer instructions for executing the steps of determining an operating parameter from both a first compressor of a multiple compressor refrigeration system and a second compressor of the multiple compressor refrigeration system, calculating a reference value using the operating parameter of the first compressor and the operating parameter of the second compressor, and comparing the calculated reference value to a predetermined value. The computer program product also includes computer instructions for executing the steps of determining an inlet vane position for both the first compressor and the second compressor, comparing the inlet vane position of the first compressor to the inlet vane position of the second compressor in response to the calculated reference value being less than the predetermined value, and determining a compressor instability in one of the first compressor and the second compressor in response to the one of the first compressor and the second compressor having both a lower operating parameter and a more open inlet vane position than the other compressor of the first compressor and the second compressor.

Still another embodiment of the present invention is directed to a stability control system for a refrigeration system comprising a lead compressor, a lag compressor, a condenser, and an evaporator connected in a closed refrigeration circuit. The lead compressor and the lag compressor each have a plurality of inlet guides vanes adjustable by an actuator. The stability control system including a first sensor configured and disposed to detect an operating parameter of the lead compressor and to generate a first signal corresponding to the detected operating parameter of the lead compressor, a second sensor configured and disposed to detect a position of the plurality of inlet guide vanes of the lead compressor and to generate a second signal corresponding to the detected position of the plurality of inlet guide vanes of the lead compressor, a third sensor configured and disposed to detect an operating parameter of the lag compressor and to generate a third signal corresponding to the detected operating parameter of the lag compressor, and a fourth sensor configured and disposed to detect a position of the plurality of inlet guide vanes of the lag compressor and to generate a fourth signal corresponding to the detected position of the plurality of inlet guide vanes of the lag compressor. The stability control system also includes a microprocessor configured to receive the first signal, the second signal, the third signal and the fourth signal during normal operation of the refrigeration system, and to generate control signals for the actuators of the plurality of inlet guide vanes of the lead compressor and the lag compressor by applying the first signal, the second signal, the third signal and the fourth signal to a control algorithm configured to determine a surge condition in one of the lead compressor and the lag compressor.

One advantage of the present invention is that it can detect and control surge in either compressor of a dual compressor system.

Another advantage of the present invention is that corrective control responses can be taken in response to the detection of an unstable operating condition without a significant time delay.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
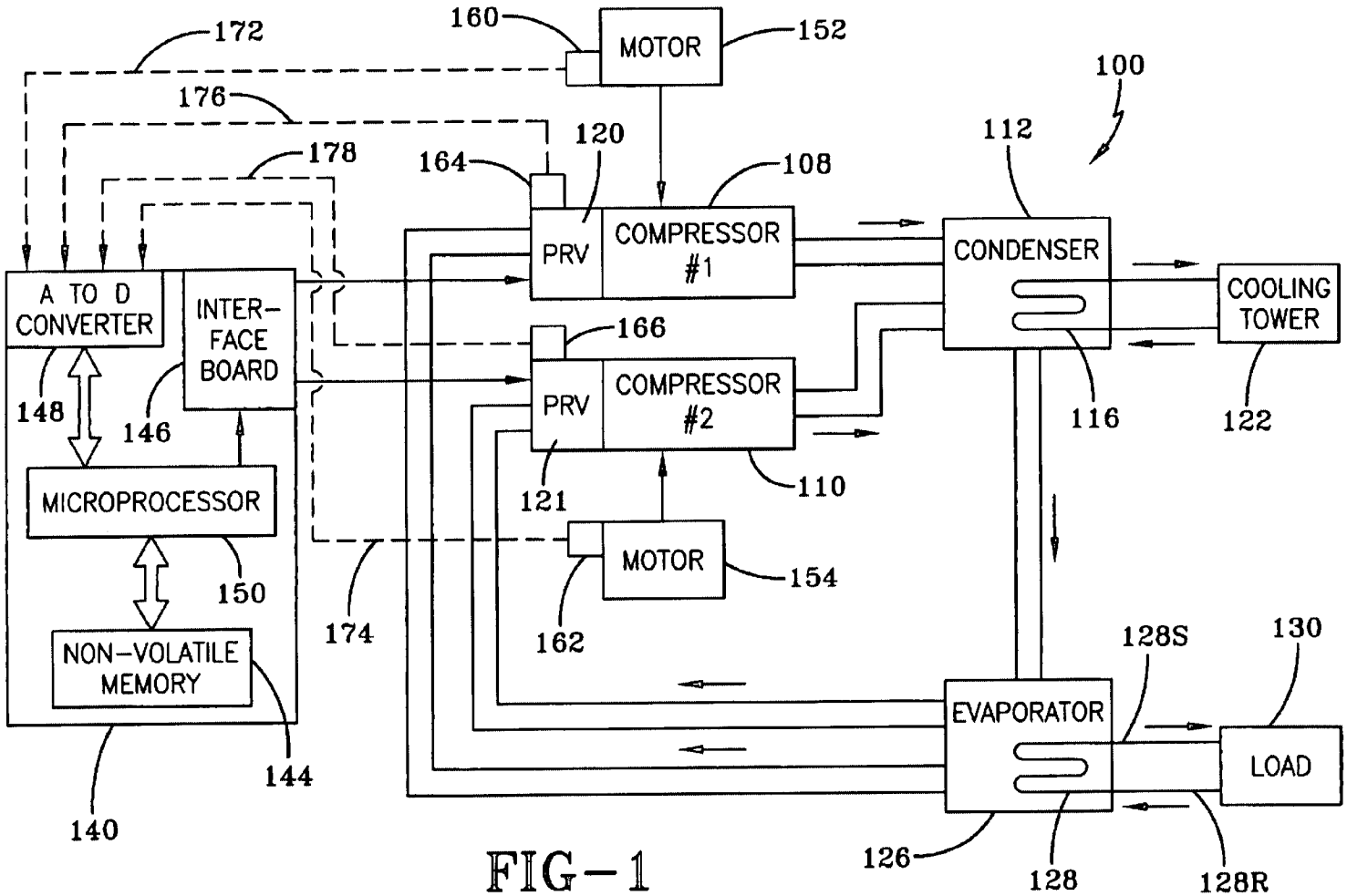
FIG. 1 illustrates schematically a refrigeration system of the present invention.

A general dual compressor system to which the invention can be applied is illustrated, by means of example, in FIG. 1. As shown, the HVAC, refrigeration or liquid chiller system 100 includes a first compressor 108, a second compressor 110, a condenser 112, a water chiller or evaporator 126, and a control panel 140. The control panel 140 includes an analog to digital (A/D) converter 148, a microprocessor 150, a non-volatile memory 144, and an interface board 146. The operation of the control panel 140 will be discussed in greater detail below. The conventional liquid chiller system includes many other features known in the art which are not shown in FIG. 1. These features have been purposely omitted to simplify the drawing for ease of illustration.

The compressors 108 and 110 compress a refrigerant vapor and deliver it to the condenser 112 by separate discharge lines. In another embodiment of the present invention, the discharge lines from the compressors 108 and 110 can be combined into a single line that delivers refrigerant vapor to the condenser 112. The compressors 108 and 110 are preferably centrifugal compressors, however the present invention can be used with any type of compressor that can experience a compressor instability or surge condition. The refrigerant vapor delivered to the condenser 112 enters into a heat exchange relationship with a fluid, preferably water, flowing through a heat-exchanger coil 116 connected to a cooling tower 122. The refrigerant vapor in the condenser 112 undergoes a phase change to a refrigerant liquid as a result of the heat exchange relationship with the liquid in the heat-exchanger coil 116. The condensed liquid refrigerant from condenser 112 flows to an evaporator 126.

The evaporator 126 can include a heat-exchanger coil 128 having a supply line 128S and a return line 128R connected to a cooling load 130. The heat-exchanger coil 128 can include a plurality of tube bundles within the evaporator 126. A secondary refrigerant liquid, which is preferably water, but can be any other suitable secondary refrigerant, e.g. ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the liquid in the heat-exchanger coil 128 to chill the temperature of the liquid in the heat-exchanger coil 128. The refrigerant liquid in the evaporator 126 undergoes a phase change to a refrigerant vapor as a result of the heat exchange relationship with the liquid in the heat-exchanger coil 128. The vapor refrigerant in the evaporator 126 then returns to the compressors 108 and 110 by separate suction lines to complete the cycle. In another embodiment of the present invention, the suction lines from the evaporator 126 to the compressors 108 and 110 can be combined into a single line exiting the evaporator 126 that then splits or branches to deliver refrigerant vapor to the compressors 108 and 110.

At the input or inlets to the compressors 108 and 110 from the evaporator 126, there are one or more pre-rotation vanes or inlet guide vanes 120 and 121 that control the flow of refrigerant to the compressors 108 and 110. Actuators are used to open the pre-rotation vanes 120 and 121 to increase the amount of refrigerant to the compressors 108 and 110 and thereby increase the cooling capacity of the system 100. Similarly, the actuators are used to close the pre-rotation vanes 120 and 121 to decrease the amount of refrigerant to the compressors 108 and 110 and thereby decrease the cooling capacity of the system 100.

To drive the compressors 108 and 110, the system 100 includes a motor or drive mechanism 152 for the first compressor and a motor or drive mechanism 154 for the second compressor 110. While the term "motor" is used with respect to the drive mechanism for the compressors 108 and 110, it is to be understood that the term "motor" is not limited to a motor but is intended to encompass any component that can be used in conjunction with the driving of the compressors 108 and 110, such as a variable speed drive and a motor starter. In a preferred embodiment of the present invention the motors or drive mechanisms 152 or 154 are electric motors and associated components. However, other drive mechanisms such as steam or gas turbines or engines and associated components can be used to drive the compressors 108 and 110.

The system 100 can include a sensor(s) 160 for sensing an operating parameter of the first compressor 108, and preferably, as shown in FIG. 1, for sensing an operating parameter of the motor 152. Similarly, the system 100 can include a sensor(s) 162 for sensing an operating parameter of the second compressor 110, and preferably, as shown in FIG. 1, for sensing an operating parameter of the motor 154. In a preferred embodiment of the present invention, the sensors 160 and 162 are current transformers located in either the motor terminal box or motor starter for measuring the current provided to each of the motors 152 and 154. In another embodiment of the present invention, the power consumption of the motors 152 and 154 can be determined by measuring with sensor(s) 160 and 162 both the current and voltage provided to each of the motors 152 and 154 to calculate the total kilowatts or power consumed by the motors 152 and 154. In embodiments of the present invention where the voltage to both of the motors is approximately equal, the measurement of the current provided to the motors 152 and 154 can be used as an adequate representation of the power consumed by the motor. The outputs of sensors 160 and 162 are then sent over lines 172 and 174 respectively to the control panel 140. In another embodiment of the present invention, the sensors 160 and 162 can be selected and positioned to measure other operating parameters of compressors 108 and 110, such as the discharge temperature or superheat, discharge flow rate and possibly the discharge pressure of the compressors 108 and 110.

A sensor 164 is used for sensing the position of the pre-rotation vanes 120 of the first compressor 108 and a sensor 166 is used for sensing the position of the pre-rotation vanes 121 of the second compressor 110. The sensors 164 and 166 are preferably positioned in relation to the actuators for the pre-rotation vanes 120 and 121 and provide actuator information that corresponds to the positions of the pre-rotation vanes 120 and 121. However, the sensors 164 and 166 can be positioned anywhere in relation to the pre-rotation vanes 120 and 121 that can provide an accurate indication of the position of the pre-rotation vanes 120 and 121. The sensors 164 and 166 are preferably variable resistance potentiometers which measure the angular rotation of the pre-rotation vane actuator or linkages. However, other types of sensors can be used. The outputs of sensors 164 and 166 are then sent over lines 176 and 178 respectively to the control panel 140.

The signals, typically analog, input to control panel 140 over lines 172–178 from sensors 160–166 are converted to digital signals or words by A/D converter 148. It is to be understood that if the control panel 140 receives digital signals from one or more of the sensors 160–166, then those signals do not need to be converted by the A/D converter 148. The digital signals representing the first compressor operating parameter, the first compressor pre-rotation vane position, the second compressor operating parameter, and the second compressor pre-rotation vane position can be converted by the microprocessor 150 into corresponding values for processing, if necessary. The processing values of the first compressor operating parameter and pre-rotation vane position and the second compressor operating parameter and pre-rotation vane position are then input into the control algorithm, which is described in more detail in the following paragraphs, to generate control signals for the actuators of the pre-rotation vanes 120 and 121. The control signals for the actuators of pre-rotation vanes 120 and 121 are provided by the microprocessor 150 to the interface board 146 of the control panel 140. The interface board 146 then provides the control signal to the actuators of the pre-rotation vanes 120 and 121 to position the pre-rotation vanes 120 and 121 into the appropriate position.

Microprocessor 150 uses the control algorithm to control the actuators of the pre-rotation vanes 120 and 121 through the interface board 146. In one embodiment, the control algorithm can be a computer program having a series of instructions executable by the microprocessor 150. The control algorithm determines when one of the compressors 108 and 110 enters into an unstable operating condition such as a surge condition and provides instructions to the actuators of the pre-rotation vanes 120 and 121 to close the pre-rotation vanes 120 and 121 to remedy the unstable condition.

While it is preferred that the control algorithm be embodied in a computer program and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

In addition to using or executing the control algorithm to detect and remedy a surge condition in one of the compressors 108 and 110, the microprocessor 150 may also use or execute the control algorithm to control the actuators of the pre-rotation vanes 120 and 121 during normal operation of the system 100, i.e. both compressors 108 and 110 are operating normally and are not in an unstable condition. However, in another embodiment of the present invention, a second control algorithm can be used or executed by the microprocessor 150 to control the system 100 during normal operation. During normal operation of the system 100, one of the compressors 108 and 110 is designated as the "lead" compressor and the other compressor is designated as the "lag" compressor. The designation of a compressor 108 and 110 as the lead compressor or the lag compressor can be dependent on several factors or goals such as equalizing compressor run time, or the capacity of the compressors. In addition, the designation of the lead compressor and the lag compressor can be changed periodically with no affect on the operation of the control algorithm. In the following description, the first compressor 108 will be designated as the lead compressor and the second compressor 110 will be designated as the lag compressor.

In a preferred embodiment of the present invention, the microprocessor 150 receives as an input a leaving chilled liquid temperature (LCHLT) signal from supply line 128S of the evaporator 126 during normal operation of the system 100. The microprocessor 150 then generates a control signal for the actuator of the pre-rotation vanes 120 of the lead compressor 108. The position of the pre-rotation vanes 120 in response to the LCHLT signal can be determined according to several well-known procedures. After the position of the pre-rotation vanes 120 of the lead compressor 108 has been determined, the position of the pre-rotation vanes 121 of the lag compressor 110 is determined. The pre-rotation vanes 121 of the lag compressor 110 are positioned to have the lag compressor 110 follow the capacity of the lead compressor 108. To follow the capacity of the lead compressor 108, the pre-rotation vanes 121 of the lag compressor 110 are positioned to obtain a motor current or power consumption in the lag compressor motor 154 that results in the lag compressor motor 154 having the same percentage of full load motor current as the lead compressor motor 152. In another embodiment of the present invention, to follow the capacity of the lead compressor 108, the pre-rotation vanes 121 of the lag compressor 110 are positioned to obtain a discharge pressure or discharge temperature in the lag compressor 110 that corresponds to a discharge pressure or discharge temperature in the lead compressor 108.

Figure 2:
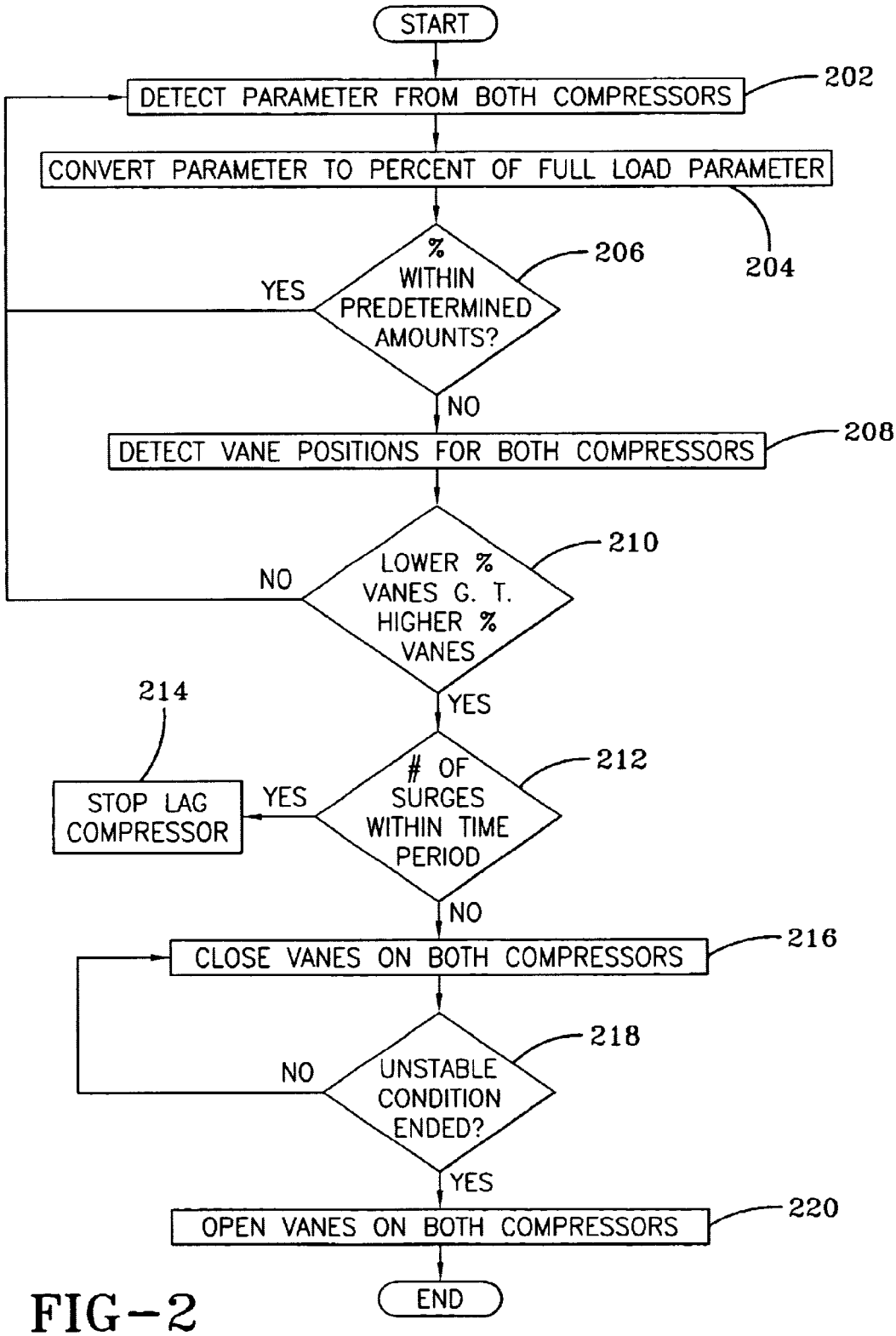
FIG. 2 illustrates a flow chart for the control algorithm for detecting and correcting an unstable operating condition.

FIG. 2 illustrates the control algorithm of the present invention for detecting and remedying or correcting an instability or surge condition during the operation of multiple compressors. The process for detecting an instability begins during normal operation of the compressors 108 and 110 at step 202. In step 202, an operating parameter is detected for both of the compressors 108 and 110. In a preferred embodiment of the present invention, an operating parameter of the compressor motors 152 and 154, e.g. the motor current or power consumption, is detected. The detected operating parameter of each compressor 108 and 110 is then converted into a percentage of the full load value of the operating parameter for that compressor 108 and 110 in step 204. The conversion of the detected operating parameter to a percentage of the full load value of the operating parameter for the compressor permits compressors of different sizes or ratings to be compared more accurately. Furthermore, and as discussed above, the percentage of full load value can be used for positioning the pre-rotation vanes 121 of the lag compressor 110 during normal operation.

In step 206, the operating parameter percentages for the compressors 108 and 110 are divided by one another to obtain a reference or ratio value. For example, if the lead compressor 108 has an operating parameter percentage of 75% and the lag compressor 110 has an operating parameter percentage of 60% then the ratio value would be (60/75) *100=80%. In a preferred embodiment of the present invention, the ratio value is calculated to be less than 100%, in this example, the lag compressor percentage is divided by the lead compressor percentage. The ratio value is then compared with a predetermined value to determine if the ratio value is less than the predetermined value, which would be indicative of unequal loading of the compressors and possibly of an unstable operating condition. The predetermined value is preferably any value between 60% and 90% with 80% being a preferred value. However, the predetermined value can be any value that corresponds to a desired sensitivity level for surge detection.

In another embodiment of the present invention, the operating parameter percentages for the compressors 108 and 110 can be subtracted from one another to obtain a reference or difference value in step 206. For example, if the lead compressor 108 has an operating parameter percentage of 75% and the lag compressor 110 has an operating parameter percentage of 60%, then the difference value would be 75−60=15%. In this embodiment, the difference value is calculated to be a positive value by subtracting the lag compressor percentage from the lead compressor percentage. The difference value is then compared with a predetermined value in step 206 to determine if the difference value is greater than the predetermined value, which would be indicative of unequal loading of the compressors and possibly of an unstable operating condition. The predetermined value is preferably any value between 10% and 30% with 20% being a preferred value. However, the predetermined value can be any value that corresponds to a desired sensitivity level for surge detection.

If the ratio value is greater than the predetermined value (or the difference value is less than the predetermined value), the process returns to step 202 to detect an operating parameter for the compressor motors 152 and 154. If the ratio value is lower than the predetermined value (or the difference value is greater than the predetermined value), the positions of the pre-rotation vanes for both compressors 108 and 110 are detected in step 208. Next, in step 210, the position of the pre-rotation vanes of the compressor having the lower or smaller operating parameter percentage is compared to the position of the pre-rotation vanes of the compressor having the larger or higher operating parameter percentage to determine if the pre-rotation vanes of the compressor having the smaller operating parameter percentage are more open or permitting more refrigerant flow than the pre-rotation vanes of the compressor having the larger or higher operating parameter percentage. If the pre-rotation vanes of the compressor having the smaller operating parameter percentage are more open than the pre-rotation vanes of the compressor having the larger or higher operating parameter percentage, then the compressor having the smaller operating parameter percentage is determined to be in an unstable or surge condition and steps are taken to correct the surge condition. If the pre-rotation vanes of the compressor having the smaller operating parameter percentage are not more open than the pre-rotation vanes of the compressor having the larger operating parameter percentage, then the smaller operating parameter percentage (lower power) present in the compressor may be due to other reasons such as lower flow loading and the compressor may not be in an unstable or surge condition. The process returns to step 202 to repeat the instability detection process. In another embodiment of the present invention, a unstable or surge condition can be detected if the pre-rotation vanes of the compressor having the smaller operating parameter percentage are open a predetermined amount more than the pre-rotation vanes of the compressor having the larger or higher operating parameter percentage.

After an unstable or surge condition has been detected in step 210, the control algorithm determines if an unstable or surge condition has been detected a predetermined number of times within a predetermined time period in step 212. If an unstable or surge condition in either the lead compressor 108 or the lag compressor 110 has been detected a predetermined number of times within the predetermined time period, the lag compressor 110 is shut down or removed from service and the operator is provided with a warning on the control panel 140 in step 214. In one embodiment of the present invention, the lag compressor 110 is shut down if 3 surge conditions are detected in a 60-minute time period. The detection of several surge conditions within a fixed time period can indicate that there is a problem with one or both of the compressors 108 and 110 or with the operation of the system 100 that requires further investigation by the operator. In another embodiment of the present invention, the lead compressor 108 can be shut down if a surge condition is detected in the lead compressor 108 the predetermined number of times. However, the shut down of the lead compressor 108 may not be required because when the lead compressor 108 is in a surge condition, the corresponding current to the lead compressor motor 152 is also reduced, which results in a reduction in the current to the lag compressor 110 in accordance with the normal operating procedure discussed above and thus providing the lead compressor 108 with an opportunity to correct the surge condition due to lower flow in the lag compressor 110.

In step 216, the pre-rotation vanes 120 and 121 to the compressors 108 and 110 are closed if an unstable or surge condition has not been detected a predetermined number of times within the predetermined time period in step 212. The closing of the pre-rotation vanes 120 and 121 to the compressors 108 and 110 restricts the flow of refrigerant to the compressors 108 and 110 and permits the surging compressor to correct the surge condition. In step 218, the compressors 108 and 110 are evaluated to determine if the surging compressor has corrected the surge condition. In a preferred embodiment of the present invention, the surge condition can be considered to be corrected in step 218 upon the ratio value from the compressor motors 152 and 154 being greater than the predetermined value. The process for determining if the surge condition has been corrected in step 218 is similar to steps 202–206 described above for determining if an unstable or surge condition is present.

If the unstable or surge condition has been corrected in step 218, then the pre-rotation vanes 120 and 121 of the compressors 108 and 110 can be opened in step 220 and the system can resume normal operation. After the system resumes normal operation, the control algorithm for detecting and correcting an unstable or surge condition can be restarted at step 202.

In another embodiment of the present invention, steps 202–206 of the control algorithm can be replaced with steps that detect and compare other system operating parameters that are indicative of a possible surge condition. For example, a drop in the compressor discharge temperature or superheat or the compressor discharge flow rate can be used with the detection of the vane position to determine if a surge condition is present. In still a further embodiment of the present invention, the control algorithm can be applied to any two compressors of a multiple compressor system of three or more compressors to detect and correct surge conditions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for detecting a compressor instability in a multiple compressor refrigeration system, the method comprising the steps of:

determining an operating parameter from both a first compressor of a multiple compressor refrigeration system and a second compressor of the multiple compressor refrigeration system;

comparing the operating parameter of the first compressor to the operating parameter of the second compressor;

determining an inlet vane position for both the first compressor and the second compressor;

comparing the inlet vane position of the first compressor to the inlet vane position of the second compressor; and determining a compressor instability in one of the first compressor and the second compressor in response to the one of the first compressor and the second compressor having both a lower operating parameter and a more open inlet vane position than the other compressor of the first compressor and the second compressor.

2. The method of claim 1 further comprising the step of closing inlet vanes on both the first compressor and the second compressor until the determined compressor instability in the one of the first compressor and the second compressor is corrected.

3. The method of claim 1 further comprising the steps of:

determining a number of times the one of the first compressor and the second compressor has had a compressor instability within a predetermined time period;

comparing the determined number of times to a predetermined number of instabilities; and stopping the one of the first compressor and the second compressor in response to the determined number of times being greater than the predetermined number of instabilities.

4. The method of claim 3 wherein the predetermined number of instabilities is 3 and the predetermined time period is 60 minutes.

5. The method of claim 1 wherein the step of determining an operating parameter includes the steps of:

measuring a motor current of the first compressor; and measuring a motor current of the second compressor.

6. The method of claim 5 wherein the step of determining an operating parameter further includes the steps of:

calculating a percentage of full load motor current for the first compressor using the measured motor current of the first compressor and a full load current value for the first compressor; and calculating a percentage of full load motor current for the second compressor using the measured motor current of the second compressor and a full load current value for the second compressor.

7. The method of claim 6 further comprising the steps of:

calculating a reference value using the operating parameter of the first compressor and the operating parameter of the second compressor;

comparing the calculated reference value to a predetermined value; and wherein the step of comparing the inlet vane position of the first compressor to the inlet vane position of the second compressor occurs in response to the calculated reference value being less than the predetermined value.

8. The method of claim 7 wherein the step of calculating a reference value includes the step of calculating a ratio value using the calculated percentage of full load motor current for the first compressor and the calculated percentage of full load motor current for the second compressor, wherein the ratio value is the ratio percentage of the calculated percentage of full load motor current for the first compressor and the calculated percentage of full load motor current for the second compressor.

9. The method of claim 8 wherein the ratio value is less than 100 percent and the predetermined value is between about 60 percent and about 90 percent.

10. The method of claim 9 wherein the predetermined value is 80 percent.

11. The method of claim 6 further comprising the steps of:

calculating a reference value using the operating parameter of the first compressor and the operating parameter of the second compressor;

comparing the calculated reference value to a predetermined value; and wherein the step of comparing the inlet vane position of the first compressor to the inlet vane position of the second compressor occurs in response to the calculated reference value being greater than the predetermined value.

12. The method of claim 11 wherein the step of calculating a reference value includes the step of calculating a difference value using the calculated percentage of full load motor current for the first compressor and the calculated percentage of full load motor current for the second compressor, wherein the difference value is the difference between the calculated percentage of full load motor current for the first compressor and the calculated percentage of full load motor current for the second compressor.

13. The method of claim 12 wherein the predetermined value is 20 percent.

14. The method of claim 1 wherein the step of determining an operating parameter includes the steps of measuring one of a discharge temperature and a discharge flow rate for both the first compressor and the second compressor.

15. A computer program product embodied on a computer readable medium and executable by a microprocessor for detecting a compressor instability in a multiple compressor refrigeration system, the computer program product comprising computer instructions for executing the steps of:

determining an operating parameter from both a first compressor of a multiple compressor refrigeration system and a second compressor of the multiple compressor refrigeration system;

calculating a reference value using the operating parameter of the first compressor and the operating parameter of the second compressor;

comparing the calculated reference value to a predetermined value;

determining an inlet vane position for both the first compressor and the second compressor;

comparing the inlet vane position of the first compressor to the inlet vane position of the second compressor in response to the calculated reference value being less than the predetermined value; and determining a compressor instability in one of the first compressor and the second compressor in response to the one of the first compressor and the second compressor having both a lower operating parameter and a more open inlet vane position than the other compressor of the first compressor and the second compressor.

16. The computer program product of claim 15 further comprising computer instructions for executing the step of closing inlet vanes on both the first compressor and the second compressor until the determined compressor instability in the one of the first compressor and the second compressor is corrected.

17. The computer program product of claim 15 further comprising computer instructions for executing the steps of:

determining a number of times the one of the first compressor and the second compressor has had a compressor instability within a predetermined time period;

comparing the determined number of times to a predetermined number of instabilities; and stopping the one of the first compressor and the second compressor in response to the determined number of times being greater than the predetermined number of instabilities.

18. The computer program product of claim 17 wherein the predetermined number of instabilities is 3 and the predetermined time period is 60 minutes.

19. The computer program product of claim 15 wherein the step of determining an operating parameter includes the steps of:

measuring a motor current of the first compressor; and measuring a motor current of the second compressor.

20. The computer program product of claim 19 wherein the step of determining an operating parameter further includes the steps of:

calculating a percentage of full load motor current for the first compressor using the measured motor current of the first compressor and a full load current value for the first compressor; and calculating a percentage of full load motor current for the second compressor using the measured motor current of the second compressor and a full load current value for the second compressor.

21. The computer program product of claim 20 wherein the step of calculating a reference value includes the step of calculating a ratio value using the calculated percentage of full load motor current for the first compressor and the calculated percentage of full load motor current for the second compressor, wherein the ratio value is the ratio percentage of the calculated percentage of full load motor current for the first compressor and the calculated percentage of full load motor current for the second compressor.

22. The computer program product of claim 21 wherein the ratio value is less than 100 percent and the predetermined value is between about 60 percent and about 90 percent.

23. The computer program product of claim 22 wherein the predetermined value is 80 percent.

24. A stability control system for a refrigeration system comprising a lead compressor, a lag compressor, a condenser, and an evaporator connected in a closed refrigeration circuit, the lead compressor and the lag compressor each having a plurality of inlet guides vanes adjustable by an actuator, the stability control system comprising:

a first sensor being configured and disposed to detect an operating parameter of the lead compressor and to generate a first signal corresponding to the detected operating parameter of the lead compressor;

a second sensor being configured and disposed to detect a position of the plurality of inlet guide vanes of the lead compressor and to generate a second signal corresponding to the detected position of the plurality of inlet guide vanes of the lead compressor;

a third sensor being configured and disposed to detect an operating parameter of the lag compressor and to generate a third signal corresponding to the detected operating parameter of the lag compressor;

a fourth sensor being configured and disposed to detect a position of the plurality of inlet guide vanes of the lag compressor and to generate a fourth signal corresponding to the detected position of the plurality of inlet guide vanes of the lag compressor; and a microprocessor configured to receive the first signal, the second signal, the third signal and the fourth signal during normal operation of the refrigeration system, and to generate control signals for the actuators of the plurality of inlet guide vanes of the lead compressor and the lag compressor by applying the first signal, the second signal, the third signal and the fourth signal to a control algorithm configured to determine a surge condition in one of the lead compressor and the lag compressor.

25. The stability control system of claim 24 wherein the microprocessor generates the control signals for the actuators of the plurality of inlet guide vanes of the lead compressor and the lag compressor in response to the control algorithm determining one of the lead compressor and the lag compressor has entered a surge condition by having both a lower operating parameter and a more open inlet vane position than the other compressor of the lead compressor and the lag compressor.

26. The stability control system of claim 25 wherein the control signals generated by the microprocessor instruct the actuators of the plurality of inlet guide vanes of the lead compressor and the lag compressor to close the plurality of inlet guide vanes of the lead compressor and the lag compressor.

27. The stability control system of claim 25 wherein the control signals generated by the microprocessor shut down the lag compressor in response to the control algorithm determining that the one of the lead compressor and the lag compressor has entered a surge condition a predetermined number of times in a predetermined time period.

28. The stability control system of claim 24 wherein:

the first sensor comprises means for measuring one of motor current and power consumption for the lead compressor; and the third sensor comprises means for measuring one of motor current and power consumption for the lag compressor.

29. The stability control system of claim 28 wherein the microprocessor calculates a percentage of full load power consumption for each of the lead compressor and the lag compressor and applies the calculated percentages of full load power consumption for the lead compressor and the lag compressor to the control algorithm to generate the control signals.

30. The stability control system of claim 24 further comprising:

an analog to digital converter to receive the first signal, the second signal, the third signal and the fourth signal from the first sensor, the second sensor, the third sensor and the fourth sensor and to convert the first signal, the second signal, the third signal and the fourth signal to digital signals for the microprocessor; and an interface board to receive the control signals from the microprocessor and to provide them to the actuators of the plurality of inlet guide vanes of the lead compressor and the lag compressor.

* * * * *